US006188561B1

(12) United States Patent
Heimberg

(10) Patent No.: US 6,188,561 B1
(45) Date of Patent: Feb. 13, 2001

(54) CIRCUIT FOR DRIVING THE EXCITATION COIL OF AN ELECTROMAGNETICALLY DRIVEN RECIPROCATING PUMP

(75) Inventor: Wolfgang Heimberg, Ebersberg (DE)

(73) Assignee: Ficht GmbH & Co. KG, Kirschseeon (DE)

( * ) Notice: Under 35 U.S.C. 154(b), the term of this patent shall be extended for 1109 days.

(21) Appl. No.: 08/676,907

(22) PCT Filed: Mar. 4, 1993

(86) PCT No.: PCT/EP93/00494

§ 371 Date: Sep. 2, 1994

§ 102(e) Date: Sep. 2, 1994

(87) PCT Pub. No.: WO93/18290

PCT Pub. Date: Sep. 16, 1993

Related U.S. Application Data

(63) Continuation of application No. 08/295,805, filed as application No. PCT/EP93/60494 on Mar. 4, 1993, now abandoned.

(30) Foreign Application Priority Data

Mar. 4, 1992 (DE) ..... 42 06 817

(51) Int. Cl.[7] ..... F02D 41/20
(52) U.S. Cl. ..... 361/154
(58) Field of Search ..... 361/154

(56) References Cited

U.S. PATENT DOCUMENTS 4,377,144 * 3/1983 Takahashi ..... 361/154 X
4,452,210 * 6/1984 Sasayama et al. ..... 361/154 X
4,944,281 * 7/1990 Suquet ..... 361/154 X

* cited by examiner

*Primary Examiner*—Fritz Fleming
(74) *Attorney, Agent, or Firm*—Kilpatrick Stockton LLP

(57) ABSTRACT

The invention pertains to a circuit for driving the excitation coil of an electromagnetically driven reciprocating pump used as an injection device, characterized by a circuit for driving the rotor excitation coil (600) which is connected to a power transistor (601) which is grounded via a measuring resistor (602), whereby the output of a comparator (603) is hooked on to the control input of the transistor (601), e.g. to the transistor base, and whereby a current setpoint is applied to the non-inverting input of the comparator (603). This setpoint is e.g. obtained from a microcomputer and the inverting input of the comparator (603) is connected to the side of the measuring resistor which is connected with the transistor (601).

2 Claims, 2 Drawing Sheets

CIRCUIT FOR DRIVING THE EXCITATION COIL OF AN ELECTROMAGNETICALLY DRIVEN RECIPROCATING PUMP

This is a continuation of application Ser. No. 08/295,805 filed Sep. 2, 1994, which is a abandoned 371 of PCT/EP 93/00494, filed Mar. 4, 1993.

BACKGROUND OF THE INVENTION

The invention pertains to a circuit for driving an excitation coil of an electromagnetically driven reciprocating pump. Such pumps are described in DD-PS 120 51 4, DD-PS 213 472 or in DE-OS 23 07 435. These pumps serve as fuel injection devices. Thereby the exact metering of the fuel to be injected is of main importance. It is known how to effect the metering of the fuel to be injected by e.g. timing. However, a purely time-based control has been found disadvantageous, because the time window available between the minimum and maximum quantity of fuel to be injected is too small to control the quantity spectrum required for engine operation in a sufficiently differentiated and reproducible manner.

SUMMARY OF THE INVENTION

The object of the invention is to create a circuit for driving the excitation coil of an electromagnetically driven reciprocating pump used for a fuel injection device, so that it becomes possible to meter differentiable fuel quantities with the reciprocating pump and that it operates largely independent of coil heating and fluctuations of the supply voltage.

This object s achieved by the characteristic features as per claim 1. Advantageous further developments of the invention.

The invention is explained in more detail below with the aid of drawings.

DESCRIPTION OF THE PREFERRED EMBODIMENT

In the case of the electromagnetic drive of the invention-based fuel injection device, the excitation, i.e. the product of the number of turns of the coil and the intensity of the current passing through the coil, is of particular importance for the electromagnetic conversion. This means that an exclusive control of the current amplitude makes it possible to select a clearly defined design of the switching performance of the drive magnet, independent of the influence of coil heating and a fluctuating supply voltage. Such a control is particularly responsive to the strongly fluctuating voltage levels and the temperature variations usual in engines.

Figure 1:
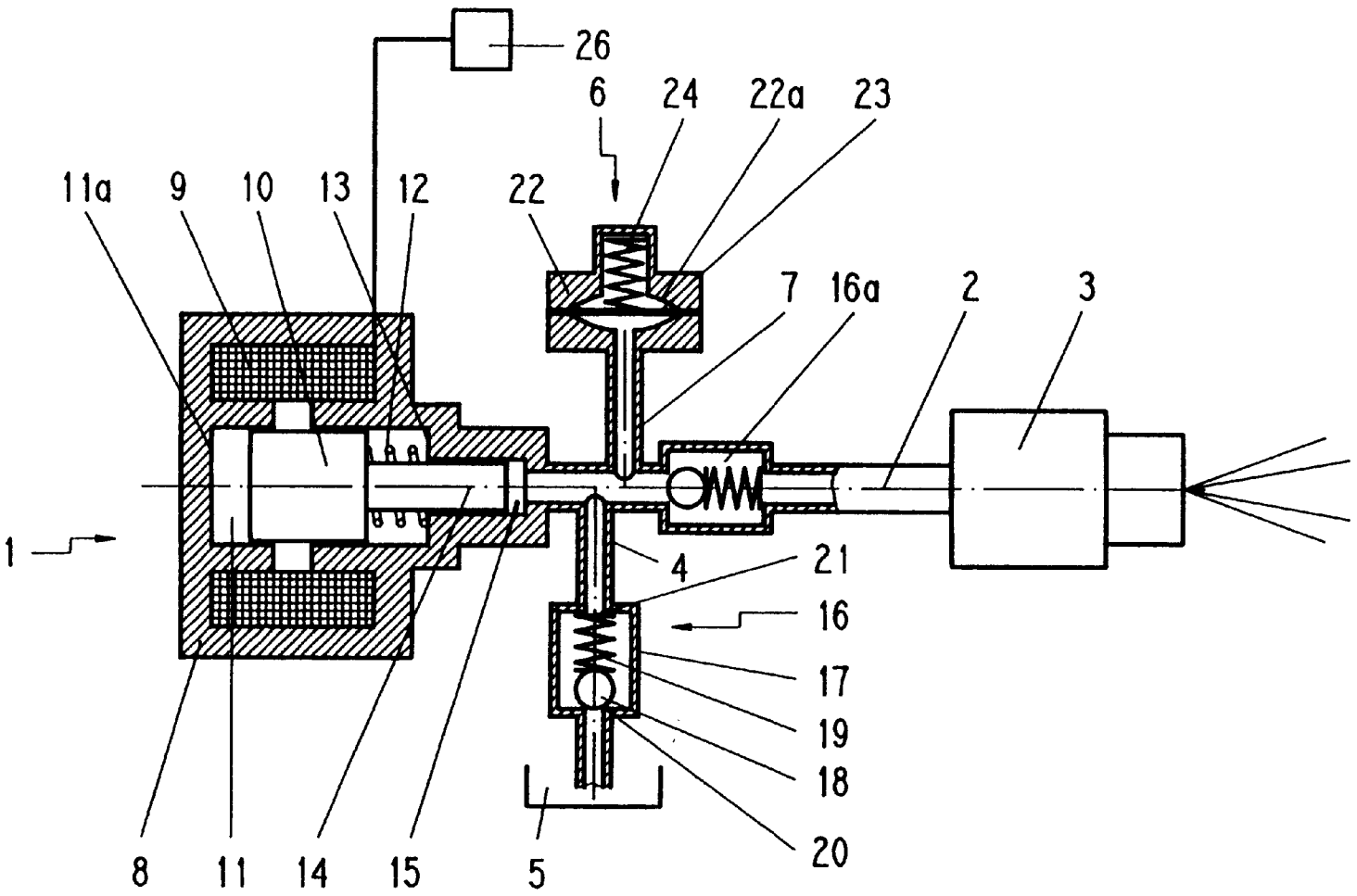
FIG. 1: example of fuel injection device

A feature of the fuel injection device shown in FIG. 1 is an initial stroke section of the delivery element of the injection pump during which the displacement of the fuel does not result in pressure build-up, whereby the stroke section of the delivery element serving for energy storage is advantageously determined by a storage volume, e.g. in the form of an empty space and a stopping element which may be of different design and which on a stroke distance "X" of the delivery element of the reciprocating pump allow the displacement of fuel. Only when the displacement of the fuel is interrupted abruptly, is a sudden pressure build-up produced in the fuel, so that a displacement of the fuel towards the injection nozzle is effected. The injection device as per FIG. 1 has an electromagnetically driven reciprocating pump 1 which is connected via a delivery line 2 to an injection device 3. From the delivery line 2 a suction line 4 branches off which is connected with a fuel tank 5. A volume storage element 6 is also connected via a line 7 to the delivery line 2 near the connection of the suction line 4.

The pump 1 is a reciprocating pump and has a housing 8 accommodating a magnet coil 9, and arranged near the coil passage, a rotor 10 in the form of a cylindrical body, e.g. a solid body, which is supported in a housing bore 11 near the central longitudinal axis of the toroid coil 9 and is pressed by a pressure spring 12 into a resting position where it rests against the bottom 11*a* of the housing bore 11. The pressure spring 12 is braced against the front face of the rotor 10 on the injector side and an annular step 13 of the housing bore 11 opposite this front face. The spring 12 encircles with clearance a delivery plunger connected rigidly, e.g. in one piece, to the rotor face on which the spring 12 acts. The delivery plunger 14 penetrates a relatively long way into a cylindrical fuel delivery space 15 formed coaxially as an extension of the housing bore 11 in the pump housing 8 and is in transfer connection with the pressure line 2. Because of the depth of penetration, pressure losses during the abrupt pressure rise are avoided, whereby the manufacturing tolerances between plunger 14 and cylinder 15 may even be relatively large, need e.g. only be of the order of a hundredth of a millimeter, so that manufacturing effort is minimal.

The suction line 4 has a non-return valve 16. The housing 17 of the valve 16 may have for valve element a ball 18 which in its resting position is pressed against its valve 20 at the tank-side end of the valve housing 17 by a spring 19. For this purpose the spring 19 is braced on one side against the ball 18 and on the other against the wall of the housing 17 opposite the valve seat 20 near the opening 21 of the suction line 4.

The storage element 6 has a housing 22 e.g. consisting of two parts in whose cavity a diaphragm 23 when stressed functions as the element to be displaced and which separates from the cavity a pressure-side space filled with fuel and when unstressed divides the cavity into two halves mutually sealed off by the diaphragm. On the side of the diaphragm 23 away from the line 7 a spring force acting on an empty space, the storage volume, e.g. a spring 24, which serves as return spring for the diaphragm 23. The end of the spring 24 opposite the diaphragm is supported on an inner wall of the cylindrically widened empty cavity. The empty cavity of the housing 22 is bounded by a domed wall forming a stop face 22*a* for the diaphragm 23.

The coil 9 of the pump 1 is connected to a control device 26 serving as electronic control for the injection device.

In the de-energized state of the coil 9, the rotor 10 of the pump 1 is on the bottom 11 a through the initial tension of the spring 12. The fuel supply valve 16 is closed and the storage diaphragm 23 is held in its position away from the stop face 22*a* in the housing cavity by the spring 24.

When the coil 9 is triggered by the control device 26, the rotor 10 is moved against the force of the spring 12 towards the injection valve 3. Thereby the plunger 14 connected to the rotor 10 displaces fuel from the delivery cylinder 15 into the space of the storage element 6. The spring forces of the springs 12, 24 are relatively weak, so that the fuel displaced by the delivery plunger 14 during the first stroke section of the delivery plunger 14 presses the storage diaphragm 23 almost without resistance into the empty space. The rotor 10 can then first be accelerated almost without resistance until the storage volume and the empty space of the storage element 6 are exhausted by the impact of the diaphragm 23 on the domed wall 22*a*. The displacement of the fuel then suddenly stops and the fuel is compressed abruptly because of the already high kinetic energy of the delivery plunger 14. The kinetic energy of the rotor 10 with delivery plunger 14 acts on the liquid. This produces a pressure impulse which travels through the pressure line 2 to the nozzle 3 and leads to the injection of fuel.

For the end of the delivery the coil 9 is de-energized. The rotor 10 is returned to the bottom 11 a by the spring 12. Thereby the liquid stores in the storage device 6 is sucked back via the lines 7 and 2 into the delivery cylinder 15 and the diaphragm 23 is pressed back into its initial position by the spring 24. Simultaneously, the fuel supply valve 16 opens, so that additional fuel is sucked from the tank 5.

Advantageously, in the pressure line 2 between the injection valve 3 and the branch lines 4, 7 a valve is arranged which maintains a static pressure in the space on the side of the injection valve, whereby this pressure is e.g. higher than the vapor pressure of the liquid at maximum operating temperature, so that the formation of bubbles is prevented. The static pressure valve may be designed like e.g. the valve 16.

A fuel injection device such as described by way of example, requires a control of the excitation coil 9 which makes differentiated quantity metering with the reciprocating pump 1 possible.

Figure 2:
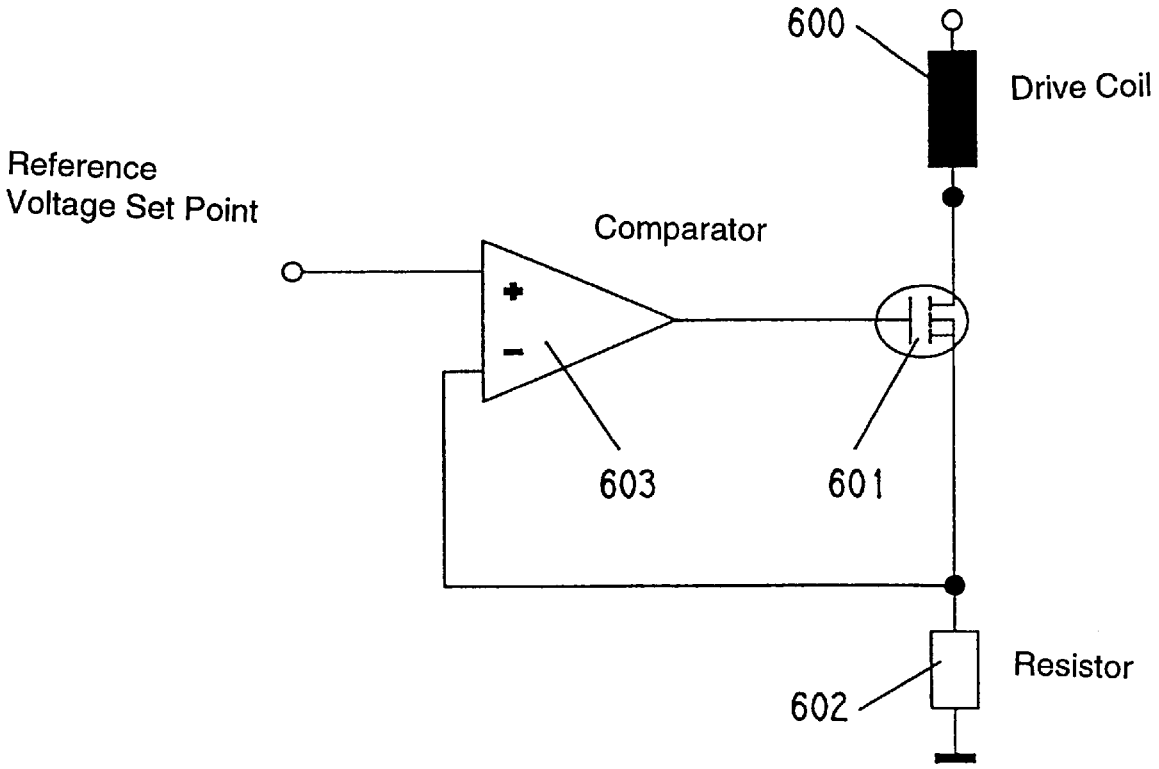
FIG. 2: wiring diagram of the invention-based circuit

FIG. 2 shows the two-step control circuit as per the invention for the current amplitude of a current controlling a pump drive coil 9, 600. The drive coil 600 is connected to a power transistor 601 which is grounded via a measuring resistor 602. The output of a comparator 603 is hooked on to the control input of the transistor 601, e.g. to the transistor base. A current setpoint is applied to the non-inverting input of the comparator. This setpoint is e.g. obtained from a microcomputer and the inverting input of the comparator 603 is connected to the transistor 601 on the side of the measuring resister.

To control the energy flow in the drive coil 9, 600 independent of the supply voltage, the current used by the coil 9, 600 is measured by the measuring resistor 602. When this current reaches the limit value given by the microprocessor as setpoint, the comparator switches off the current for the coil 9, 600 via the power transistor 601. As soon as the actual current falls below the current setpoint, the transistor switches the coil current on again via the comparator 603. The current rise delay caused by the inductivity of the coil 9, 600 prevents that the maximum permissible current is exceeded too rapidly.

After that the next switching cycle can begin and this clocking of the coil current of the coil 9,600 continues as long as the reference voltage supplying the current setpoint prevails at the non-inventing input of the comparator 603. The invention-based circuit represents a clocked power source, whereby the clocking only sets in when the current setpoint supplied by the microprocessor has been reached. The energy control and with it the quantity control of the pump device 1 can be carried out with this circuit in a combination of duration and/or intensity of the reference voltage supplied by the microprocessor.

What is claimed is:

1. A reciprocating pump used as a fuel injection device, comprising:

an excitation coil which is driven by an excitation current;

an armature operatively associated with the excitation coil for operating a fluid-displacement element of the pump; and an excitation circuit operative for supplying current pulses to the excitation coil, the excitation circuit comprising;

a power transistor in series with the excitation coil and with a measuring resistor having a side connected to the transistor;

a comparator having an output and two inputs, the output being connected to a control input of the transistor;

one input of the comparator being responsive to a selectively variable reference signal corresponding to a predetermined target current in the excitation coil; and the other input of the comparator being connected to the side of the measuring resistor that is connected to the transistor and thus being responsive to the actual current through the excitation coil, so that the comparator compares the actual current and the target current and operates to drive the transistor to adjust the actual current to the target current, and to turn off the current through the excitation coil when the actual current exceeds the target current, so that the current through the excitation coil is repeatedly switched off and on as long as the reference signal prevails at the one input of the comparator, whereby the excitation coil is controlled by both the duration and amplitude of the reference signal to the comparator.

2. The pump as in claim 1, wherein the armature operates a reciprocating fluid-displacement element of the pump in response to the selected combination of duration and amplitude of the target current value.

* * * * *